US005257438A

United States Patent [19]

Faas et al.

[11] Patent Number: 5,257,438

[45] Date of Patent: * Nov. 2, 1993

[54] DOSING METHOD AND APPARATUS FOR THE DELIVERY OF PREDETERMINATE QUANTITIES OF FIBER FLOCKS PER UNIT OF TIME

[75] Inventors: Jurg Faas, Dinhard; Peter Brutsch, Neuhausen; Robert Demuth, Nurensdorf, all of Switzerland

[73] Assignee: Maschinenfabrik Rieter AG, Winterthur, Switzerland

[ * ] Notice: The portion of the term of this patent subsequent to Jun. 16, 2009 has been disclaimed.

[21] Appl. No.: 743,498

[22] Filed: Aug. 9, 1991

Related U.S. Application Data

[63] Continuation-in-part of Ser. No. 480,123, Feb. 14, 1990, Pat. No. 5,121,523.

[30] Foreign Application Priority Data

Aug. 10, 1990 [DE] Fed. Rep. of Germany ..... 4025476

[51] Int. Cl.[5] ..... D01G 13/00; D01B 1/00

[52] U.S. Cl. ..... 19/145.5; 19/105; 19/296; 19/97.5; 222/1; 222/63; 222/64

[58] Field of Search ..... 19/145.5, 145.7, 296, 19/297, 300, 105, 97.5; 222/1, 63, 64

[56] References Cited

U.S. PATENT DOCUMENTS

| | | | |
|---|---|---|---|
| 3,889,319 | 6/1975 | Roberson . | |
| 4,403,374 | 9/1983 | Wood | 19/105 |
| 4,682,388 | 7/1987 | Pinto . | |
| 4,709,451 | 12/1987 | Leifeld | 19/105 |
| 4,742,675 | 5/1988 | Leifeld | 19/105 |
| 4,776,065 | 10/1988 | Rake et al. | 19/105 |
| 4,928,355 | 5/1990 | Leifeld | 19/105 |
| 4,930,190 | 6/1990 | Leifeld | 19/105 |
| 4,939,815 | 7/1990 | Leifeld | 19/105 |
| 5,121,523 | 6/1992 | Brutsch et al. | 19/97.5 |

FOREIGN PATENT DOCUMENTS

| | | | |
|---|---|---|---|
| 0383246 | 8/1990 | European Pat. Off. . | |
| 196821 | 6/1907 | Fed. Rep. of Germany . | |
| 3151063 | 7/1983 | Fed. Rep. of Germany . | |
| 3713590 | 10/1987 | Fed. Rep. of Germany . | |
| 3733631 | 4/1989 | Fed. Rep. of Germany | 19/105 |
| 3913997 | 8/1990 | Fed. Rep. of Germany . | |
| 1270586 | 7/1961 | France . | |
| 2588282 | 4/1987 | France . | |
| 62-263327 | 11/1987 | Japan . | |
| 313355 | 4/1956 | Switzerland . | |
| 735172 | 8/1955 | United Kingdom . | |
| 2236335 | 4/1991 | United Kingdom | 19/105 |

*Primary Examiner*—Clifford D. Crowder
*Assistant Examiner*—Michael A. Neas
*Attorney, Agent, or Firm*—Sandler, Greenblum & Bernstein

[57] ABSTRACT

The dosing method and apparatus meters predeterminate quantities of fiber flocks per unit of time by means of two feed devices arranged at the lower end of a flock chute and which form therebetween a conveying gap and an opening roll is preferably arranged beneath the feed devices. The feed devices selectively comprise either:

(a) a rotatable feed roll and an oppositely situated slide; or
(b) a rotatable feed roll and an oppositely situated driven or freely revolving belt; or
(c) two oppositely situated revolving belts, wherein at least one of the revolving belts is driven and the other either revolves or is likewise driven; or
(d) a driven revolving belt and a oppositely situated slide; or
(e) a rotatable feed roll and an oppositely situated freely rotatable further feed roll; or
(f) a rotatable feed roll and an oppositely situated feed trough; or wherein, for all of the indicated possible embodiments (a) to (f) the conveying gap converges to a minimum width and at least one of the feed devices is pre-biased in the direction of the other feed device and is movable away from the other feed device by the force of the fiber flocks such that the spacing between both of the feed devices is changed in the sense that there is altered the minimum width x of the conveying gap, there is selectively determined the minimum width of the conveying gap or a value proportional thereto, and the surface velocity u of the driven feed device or feed devices is regulated such that at least the average value of the product x·u of this minimum width x and the surface velocity u remains essentially constant.

18 Claims, 10 Drawing Sheets

DOSING METHOD AND APPARATUS FOR THE DELIVERY OF PREDETERMINATE QUANTITIES OF FIBER FLOCKS PER UNIT OF TIME

CROSS-REFERENCE TO RELATED APPLICATION

This application is a continuation-in-part of application Ser. No. 480,123, filed on Feb. 14, 1990, now U.S. Pat. No. 5,121,523.

BACKGROUND OF THE INVENTION

1. Field of the Invention

The present invention relates to a new and improved dosing or metering method and apparatus for the delivery of predeterminate or determinable quantities of fiber flocks per unit of time by means of two feed devices arranged at the lower end of a fiber flock filling or feed chute and which two feed devices form therebetween a conveying or feed gap.

2. Discussion of the Background and Material Information

A dosing method and apparatus of this type is disclosed, for instance, in Great Britain Patent No. 735,172 and the cognate Swiss Patent No. 313,355, granted Apr. 15, 1956. A similar method and apparatus is also known from the German Published Patent No. 3,713,590, published Oct. 8, 1987, but additionally uses an opening or opener roll located beneath the feed rolls forming the feed devices.

Further examples of such equipment have been disclosed in German Patent No. 196,821, granted Jun. 30, 1907, German patent No. 3,151,063, published May 24, 1984 and Japanese Patent Document No. 62-263,327, dated Nov. 16 1987.

During the manufacture of yarn there are usually blended or admixed mixtures of different fiber-like constituents, that is to say, fibers of different origins, types, quality, color or other attributes, in order to produce fiber blends which are subsequently carded and delivered to the further spinning operations.

The blending or mixing of the fibers can be accomplished in that the different types of fibers are filled into associated filling or feed chutes and deposited upon a revolving conveyor belt or band by the feed rolls located at the lower end of the filling or feed chutes. As a result, there is produced a continuous layered or sandwich structure upon the revolving conveyor belt or band which is then delivered to an opening roll. This opening roll extracts individual fiber flocks from the layered structure and promotes good admixing or blending of the different fibers of the different layers which were previously deposited upon the conveyor belt. It is possible to determine the momentarily desired proportion of the individual fiber constituents by controlling the rotational speed of the individual feed rolls.

Efforts have been expended to control the filling height of the fiber flocks in the individual filling or feed chute such that this filling height remains essentially constant, so that with a constant fill height and predetermined rotational speed of the feed rolls the momentarily required fiber quantity is dosed or deposited upon the revolving conveyor belt.

With these prior art dosing methods and dosing apparatuses it is only possible to achieve to a limited extent the momentarily prescribed dosed quantity of fiber flocks. The heretofore known apparatuses only take into account relatively inaccurately fluctuations in the density, the fill height and the degree of opening of the fiber flocks.

The presence of such inaccuracies promoted the use of balance feeds where the individual constituents are weighed prior to blending. However, such type of equipment is relatively complicated and expensive.

SUMMARY OF THE INVENTION

Therefore, with the foregoing in mind, there existed in the art the object to improve upon a dosing method and apparatus of the aforementioned type in such a manner that with favorable economies in the performance of the dosing method and for the production of the dosing apparatus there can be achieved high dosing accuracy, and specifically, without the need to have to exactly predetermine the filling height of the fiber flocks in the filling or feed chute.

In order to fulfill this object there has been taught in the commonly assigned, copending United States application Ser. No. 07/480,123, filed Feb. 14, 1990, entitled "Metering Method and Metering Apparatus for Dispensing Predeterminable Quantities of Fiber Flocks", the disclosure of which is incorporated herein in its entirety by reference, as well as the cognate European Published Patent Application No. 0,383,246, published Aug. 22, 1990 and the cognate German Published Patent Application No. 3,913,997, published Aug. 23, 1990, a dosing method where the feed devices are constituted by feed rolls rotatable in opposite directions. Additionally, at least one of the feed rolls is biased or loaded in the direction of the other feed roll and can be retracted therefrom by the pressure or force exerted by the fiber flocks. There is measured the spacing between both of the feed rolls or a value which is proportional to such spacing, and the rotational speed of at least one of the feed rolls is regulated such that at least on average or mean the product $n \cdot x$ of the rotational speed n and the feed roll spacing x remains constant.

Regarding the apparatus aspects, this aforementioned commonly assigned, copending U.S. application Ser. No. 07/480,123, filed Feb. 14, 1990 and the likewise aforementioned cognate European and German Published Patent applications contemplate mounting for displacement the axis of rotation of the one feed roll towards and away from the axis of rotation of the other feed roll and biasing or loading the one feed roll in the direction of the rotational axis of the other feed roll. Furthermore, there is provided a path measuring device or transducer which determines the spacing between both of the feed rolls resulting during the flock feed or value which is proportional to such feed roll spacing. A regulator serves to regulate the rotational speed of the feed rolls as a function of the determined feed roll spacing in order to attain a predetermined reference or set value of the momentary production.

With that in mind, a specific object of the present invention aims at accomplishing alternate solutions of the previously stated object.

Now in order to implement these and still further objects of the present invention, which will become more readily apparent as the description proceeds, the dosing or metering method of the present development for the delivery of predeterminable quantities of fiber flocks per unit of time by means of two feed devices arranged at the lower end of a filling or feed chute for fiber flocks and which feed devices form therebetween a conveying or feed gap, and wherein an opening roll is preferably arranged beneath the feed devices, is manifested, among other things, upon the recognition that the solution of the aforementioned object not only can be realized by means of two feed rolls, but also then when the feed devices selectively comprise either:

(a) a rotatable feed roll and a oppositely situated slide or chute, or
(b) a rotatable feed roll and an oppositely situated driven or freely revolving belt or band, or
(c) two oppositely situated revolving belts or bands, wherein at least one of the revolving belts or bands is driven and the other either revolves or is likewise driven, or
(d) a driven revolving belt or band and an oppositely situated slide or chute, or
(e) a rotatable feed roll and an oppositely situated freely rotatable further feed roll, or
(f) a rotatable feed roll and an oppositely situated feed trough, wherein, for all of the indicated possible embodiments or arrangements (a) to (f) the conveying or feed gap converges to a minimum width and at least one of the feed devices is prebiased in the direction of the other feed device and is movable away from the other feed device by the force of the fiber flocks such that the spacing between both of the feed devices is changed in the sense that there is altered the minimum width x of the conveying or feed gap, there is determined the minimum width of the conveying or feed gap or a value proportional thereto, and the surface velocity u of the driven feed device or feed devices is regulated such that at least the average or mean value of the product x·u of this minimum width x and the surface velocity u remains essentially constant.

As previously indicated, the present invention is not only concerned with a fiber flock dosing or metering method, but also to a fiber flock dosing or metering apparatus which is particularly suitable for the performance of the inventive method. This fiber flock dosing apparatus serves for the delivery of predeterminable quantities of fiber flocks per unit of time by means of two feed devices arranged at the lower end of a feed chute for fiber flocks and which feed devices form therebetween conveying or feed gap, and wherein an opening roll is preferably arranged beneath the feed devices. According to the inventive dosing apparatus, the feed devices comprise either:

(a) a rotatable feed roll and an oppositely situated slide or chute, or
(b) a rotatable feed roll and an oppositely situated driven or freely revolving belt or band, or
(c) two oppositely situated revolving belts or bands, wherein at least one of the revolving belts or bands is driven and the other either revolves or is likewise driven, or
(d) a driven revolving belt or band and an oppositely situated slide or chute, or
(e) a rotatable feed roll and an oppositely situated freely rotatable further feed roll, or
(f) a rotatable feed roll and an oppositely situated feed trough, wherein, for all of the indicated possible embodiments or arrangements (a) to (f) the conveying or feed gap converges to a minimum width, that there is provided a pre-biasing or pre-loading device for biasing or loading at least one of the feed devices in the direction of the other feed device, at least one of the feed devices is arranged to be movable away from the other feed device by the force of the fiber flocks, there is provided a path measuring device or transducer which determines the spacing, arising during operation of the flock feed, between both of the feed devices at the location of the minimum width or a value which is proportional thereto, and that there is provided a regulator which regulates the surface velocity u of the movable feed device or feed devices as a function of the determined spacing x in the sense that there is achieved a predetermined reference value $\dot{m}_{ref}$ of the instantaneous or momentary production $\dot{m}$.

It is the merit of the inventors to have recognized that the following Equation (1), which has been set forth in the aforementioned commonly assigned, copending U.S. application Ser. No. 07/480,123, filed Feb. 14, 1990, namely:

$$\dot{m} = \frac{K \cdot \int_{t1}^{t2} n \cdot x \cdot dt}{t2 - t1} \qquad \text{(Eq. 1)}$$

also retains its validity for other feed devices, although the constant K assumes a different value and there is used, instead of the rotational speed n of the feed roll the surface velocity u of the driven feed device or feed devices.

As a further extension of this concept an alternative solution of the afore-described object, as concerns the method aspects, contemplates that the feed devices comprise either:

(a) two oppositely situated rotatable feed rolls, or
(b) a rotatable feed roll and an oppositely situated slide or chute, or
(c) a rotatable feed roll and an oppositely situated driven or freely revolving belt or band, or
(d) two oppositely situated revolving belts or bands, wherein at least one of the revolving belts or bands is driven and the other either revolves or is likewise driven, or
(e) a driven revolving belt or band and an oppositely situated slide or chute, or
(f) a rotatable feed roll and an oppositely situated freely rotatable further feed roll, or
(g) a rotatable feed roll and an oppositely situated feed trough, wherein, the relative position of both of the feed devices mutually opposite one another is maintained at P least essentially constant during simultaneous measurement of the force p which urges apart both of the feed devices or a value proportional thereto is maintained at least essentially constant, and the surface velocity u of the driven feed device or feed devices is regulated which taking into account the changing force such that at least the average or mean value of the product u·p of this surface velocity u and the force P remains essentially constant.

As to the apparatus aspects, this solution relies upon the fact that the feed device comprise either:

(a) two oppositely situated rotatable feed rolls, or
(b) a rotatable feed roll and an oppositely situated slide or chute, or
(c) a rotatable feed roll and an oppositely situated driven or freely revolving belt or band, or
(d) two oppositely situated revolving belts or bands, wherein at least one of the revolving belts or bands is driven and the other either revolves or is likewise driven, or (e) a driven revolving belt or band and an oppositely situated slide or chute, or (f) a rotatable feed roll and an oppositely situated freely rotatable further feed roll, or (g) a rotatable feed roll and an oppositely situated feed trough, wherein, for all of the indicated possible embodiments or arrangements (a) to (g) the conveying or feed gap converges to a minimum width, that only for a predetermined or desired production $\dot{m}_{ref}$ the relative position of both of the feed devices mutually opposite one another is maintained at least essentially constant, that there is provided a force measuring device in order to measure the force p which strives to urge apart both of the feed devices, and that there is provided a regulator which regulates the surface velocity u of the driven feed device or feed devices as a function of the determined force such that there is realized the predetermined reference value $\dot{m}_{ref}$ of the instantaneous or momentary production $\dot{m}$.

During the derivation of Equation 1 indicated in the aforementioned commonly assigned, copending U.S. application Ser. No. 07/480,123, filed Feb. 14, 1990, there has been considered the correlation with the density of the product located in the conveying or feed gap. The inventors of the present development have recognized that an Equation of the same form as Equation 1 also then results if there is maintained essentially constant the working space or distance between both of the feed devices and instead of measuring the change of such working space or distance there is measured the changing force at the feed devices. This force is, in fact, proportional to the density of the flock stream moving through the conveying or feed gap. There is then obtained Equation 2 which is expressed as follows:

$$\dot{m} = \frac{K \cdot \int_{t_1}^{t_2} u \cdot P \cdot dt}{t_2 - t_1} \quad \text{(Eq. 2)}$$

wherein, reference character u represents the surface velocity of the driven feed device and reference character P represents the above-mentioned force. Also, in this case K is a constant which, however, assumes a different value than for Equation 1 and the corresponding Equation of the aforementioned commonly assigned, copending U.S. application Ser. No. 07/480,123, filed Feb. 14, 1990.

In order to provide a clearer description and comprehension of the present invention, in the discussion of the following drawings accompanying this disclosure there will be firstly, once again, described in detail FIGS. 1 to 8 of the aforementioned commonly assigned, copending U.S. application Ser. No. 07/480,123, filed Feb. 14, 1990, and thereafter, in conjunction with FIGS. 9 to 16 there will be described exemplary embodiments of the present invention.

BRIEF DESCRIPTION OF THE DRAWINGS

Therefore, the invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
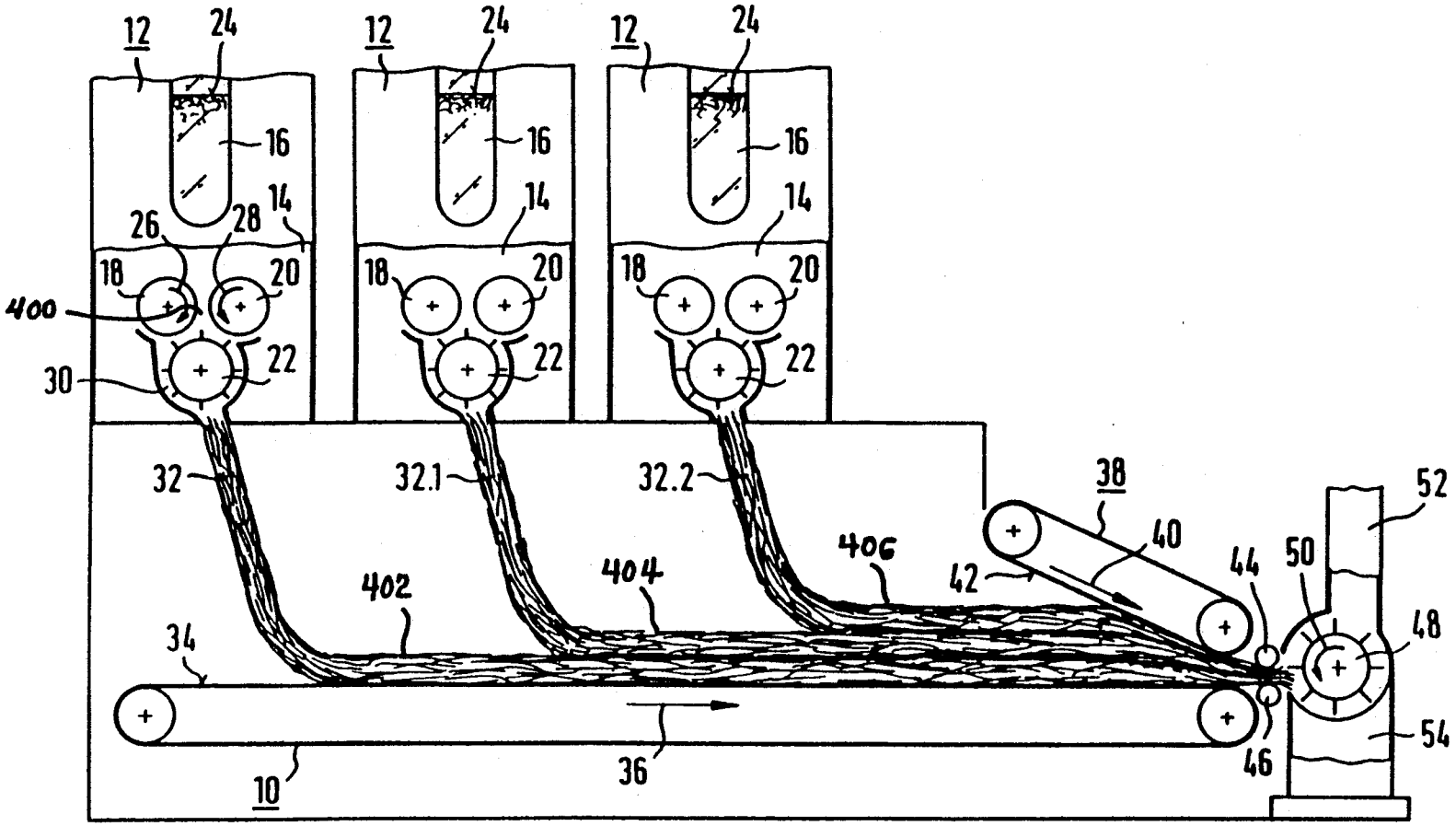
FIG. 1 is a schematic side view of a blending or mixing installation which is equipped, by way of example, with three dosing or metering apparatuses according to the present invention.

Describing now the drawings, it is to be understood that only enough of the construction of the chute feeder and related dosing and metering apparatuses have been depicted therein, in order to simplify the illustration, as needed for those skilled in the art to readily understand the underlying principles and concepts of the present invention.

It is here also mentioned that throughout the various figures there have been generally used in the description of the different embodiments the same reference characters to denote the same elements or parts; however, there has used a decimal point followed by a further reference character in those instances where there arise deviations or alterations from the previously described parts or elements.

Turning attention now to FIG. 1, the exemplary embodiment of mixing or blending apparatus depicted therein comprises a revolving conveyor belt or band 10 and three identically constructed dosing or metering apparatuses arranged in a row above the conveyor belt or band 10. As will be explained more fully hereinafter, each such dosing or metering apparatus 12 comprises a filling or feed chute 14 with a viewing or sight window 16 and two to three feed means, such as feed rolls 18 and 20 arranged at the lower end of the filling chute 14, as well as an opening or opener roll 22. The fiber flocks lying in the filling chute 14, wherein the upper fill limit or boundary is indicated by reference numeral 24, are engaged by the feed rolls 18 and 20 rotating in the indicated directions 26 and 28, respectively, and are delivered to the opening roll 22 through a conveying or feed gap, here generally indicated by reference character 400, formed between both of the feed rolls 18 and 20. The opening roll 22 rotates faster than the feed rolls 18 and 20 and separates fiber flocks out of the infed flock wad or mat which are then delivered through the duct or channel 30 in the form of opened, loose flocks 32 defining a fiber flock layer 402 onto the upper run 34 of the conveyor belt or band 10.

The loose bundles of fiber flocks 32.1 and 32.2 originating from the other two dosing or metering apparatuses 12 are deposited in the form of layers 404 and 406, respectively, upon the first fiber flock layer 402 formed by the bundle of fiber flocks 32 and transported in the direction of the arrow 36 upon the upper run of the conveyor belt 10 to the mixing or blending device shown at the right side of FIG. 1. At that location there is present a further revolving conveyor belt or band 38 which revolves or circulates in the direction of the arrow 40 and the lower run 42 of which is inclined with respect to the transport or conveying direction 36 towards the upper run 34 of the conveyor belt 10. As a result, the three fiber flock layers 402, 404 and 406 are compressed and subsequently captured in the conveying gap of the two feed or delivery rolls 44 and 46. The feed rolls 44 and 46 deliver the thus formed sandwich structure to an opening or opener roll 48 which revolves in the direction of the arrow 50 and extracts the fiber flocks out of the sandwich structure and transfers such for further processing through the chute or shaft 52. Contaminants or waste which have been possibly released due to opening of the fiber flocks by the opening roll 48 are collected in a waste or contaminant chamber 54 and, if desired, removed from this location by an air current or air flow.

It should be understood that the exemplar embodiment depicted in FIG. 1 is in no way limited to the use of three dosing apparatuses 12; quite to the contrary any random desired number of fiber flock layers can be arranged upon the conveyor belt 10.

Figure 2:
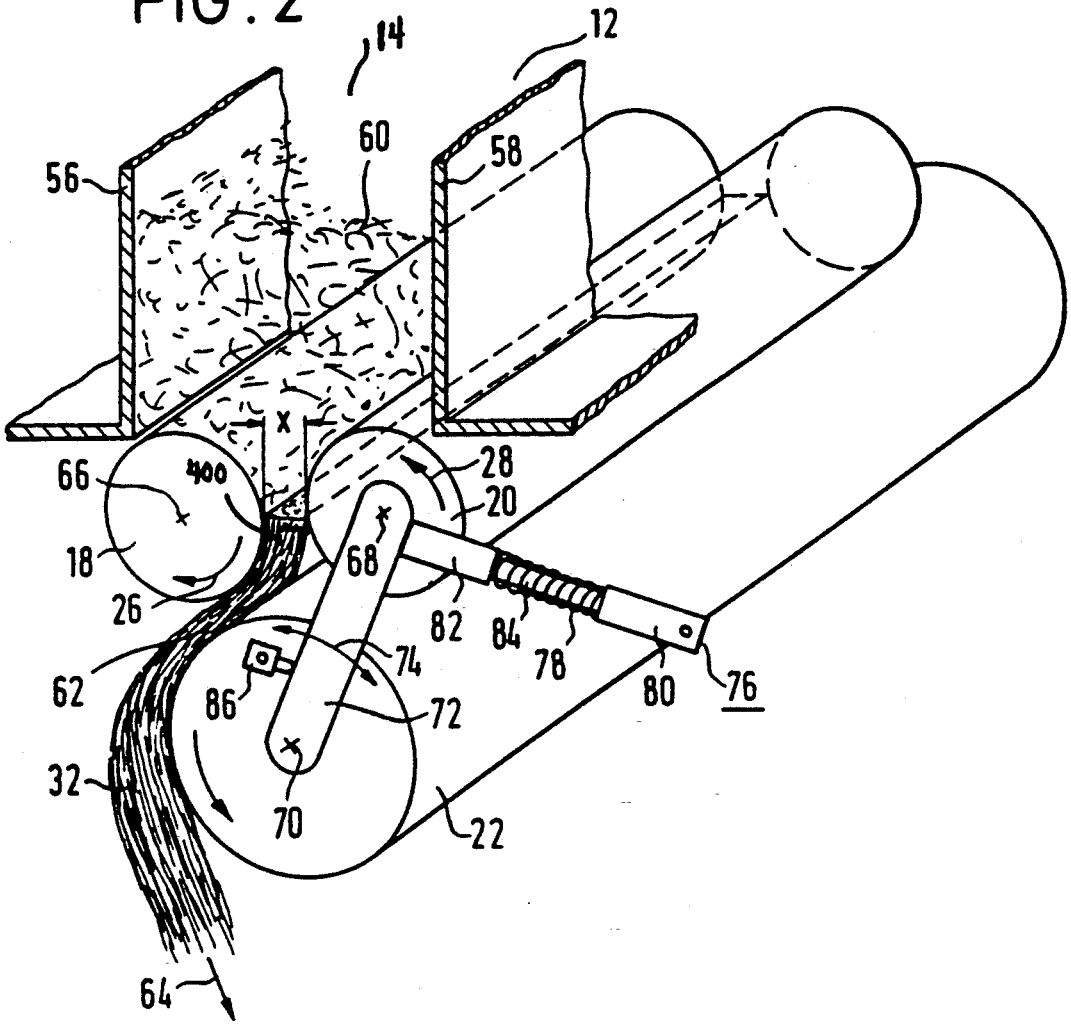
FIG. 2 is a perspective view of the two feed rolls and the opening roll of a dosing or metering apparatus according to the present invention.

A practical embodiment of the feed rolls I8 and 20 and the opening roll 22 is shown in greater detail in FIG. 2.

The two side walls 56 and 58 of the fiber flock filling chute 14 extend near to the peripheral surfaces of the feed rolls 18 and 20, respectively, and slightly diverge from one another, so that there is precluded flock jamming or obstruction. The fiber flocks 60 in the filling chute 14 exhibiting a high degree of opening, are engaged by the feed rolls 18 and 20 rotating in the opposite directions 26 and 28, respectively, and compressed into a wad or mat 62 of fiber flocks. The opening roll 22 then releases the fiber flocks from the flock wad or mat 62 and forms a fiber flock stream or flow 32 which moves further in the direction of the arrow 64 towards the conveyor belt or band 10. All of the fiber flocks 60 acted upon by the feed rolls 18 and 20 revolving at the rotational speed n are transported through the conveying or feed gap whose width x represents the smallest spacing between both of the feed rolls 18 and 20 and the length 1 of which corresponds to the length of the feed rolls 18 and 20 and the width of the side walls 56 and 58 of the filling chute 14.

The rotational shaft or axle of the feed roll 18 is generally designated by reference numeral 66, the rotational shaft or axle of the feed roll 20 is generally designated by reference numeral 68, and the rotational shaft or axle of the opening roll 22 is generally designated by reference numeral 70. The rotational shaft 66 of the feed roll 18, just as is the case for the rotational shaft 70 of the opening roll 22, is fixedly mounted in the filling chute 14. However, the rotational shaft 68 of the feed roll 20 is supported by two arms or guides 72, only one of which is visible in the showing of FIG. 2. The other arm 72 is located at the opposite side or end face of the feed roll 20 and is structured exactly like the depicted arm 72. Each such arm 72 is journaled at the rotational shaft 70 of the opening roll 22, and thus, can carry out rotational movements about the rotational shaft 70 in the direction of the double-headed arrow 74. As should be readily apparent, these movements result in changes in the spacing x between the feed rolls 18 and 20.

A pre-biasing or pre-loading device 76 is shown at the right-hand side of FIG. 2. More specifically, this pre-biasing or pre-loading device 76 here comprises a pre-biasing spring 78 bearing at one end against an abutment or impact member 80 fixedly arranged at the filling chute 14 and at its opposite end bearing against an abutment or impact member 82 connected with the arm or guide 72. A rod or bar 84 extends between the abutments or impact members 80 and 82 and is arranged to be displaceable within the abutment or impact member 82. It will be understood that a further pre-biasing or pre-loading device 76 is arranged at the region of the opposite side or end face of the feed roll 20 and at that location presses against the associated arm or guide 72. Both of the springs 78 therefore strive to reduce the size of the spacing x between the feed rolls 18 and 20. The minimum spacing x between the feed rolls 18 and 20 is determined by an abutment or impact device 86 which coacts with the arm 72 depicted in FIG. 2. Once again, a further abutment or impact device 86 is arranged at the region of the opposite side or end face of the feed roll 20 and coacts in like manner with the there located arm or guide 72.

The spacing x between the feed rolls 18 and 20 is altered during operation depending upon the pressure prevailing in the filling chute 14, the density and the degree of opening of the fiber flocks 60 and the force of the pre-biasing or biasing springs 78, and the magnitude of this spacing x can be detected by the displacement motion of the rod 84 within the abutment or impact member 82. This rod 84 and the abutment or impact member 82 are constructed to define a path measuring device or transducer.

Figure 3:
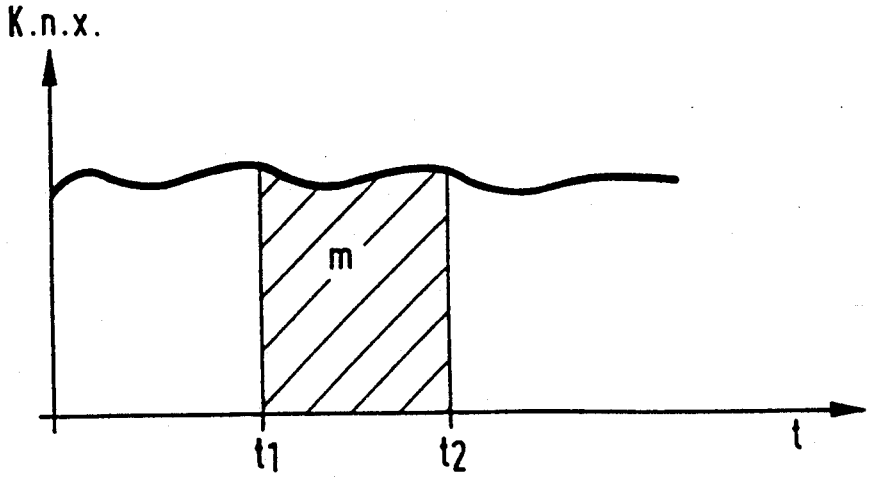
FIG. 3 is a graph for explaining the regulation operation or method.

The dosing or metering method of the present invention and the accomplished regulation will be fully considered in connection with FIG. 3.

Initially there will be introduced the following definitions:

m = mass;

t = time;

$\dot{m}$ = mass flow = relative production of a dosing apparatus = mass per unit of time;

$\dot{v}$=volume flow=volume per unit of time;
$\rho$=material density;
n=rotational speed of the feed rolls;
u=peripheral or surface speed of the feed rolls;
d=diameter of the feed rolls;
l=length of the feed rolls;
x=variable width of the opening of the conveying gap;
A=opening cross-section of the conveying gap=l·x; and
s=transport length.

The mass flow equal to the instantaneous production m is equal to $\dot{v}\cdot\rho$.

While taking into account the above-listed definitions there also can be derived the following Equation:

$$\dot{m} = \dot{v}\cdot\rho = \frac{v}{t}\cdot\rho = \frac{A\cdot s}{t}\cdot\rho = \frac{l\cdot x\cdot s}{t}\cdot\rho;$$

$$m = \frac{l\cdot x\cdot u\cdot \cancel{t}}{\cancel{t}}\cdot\rho = l\cdot x\cdot d\cdot\pi\cdot n\cdot\rho;$$

Now $\rho$ here represents the material density in the conveying gap and this is at least essentially owing to the pre-bias with essentially constant force. Since d, $\pi$ and l are also constant there can be written:

$$\rho\cdot d\cdot\pi\cdot l = K;$$

Furthermore, there prevails the relationship:

$$\dot{m} = \frac{dm}{dt} = K\cdot n\cdot x;$$

that is to say, dm=K·n·x·dt, and from this relationship there can be computed:

$$m = K\cdot\int_{t_1}^{t_2} n\cdot x\cdot dt;$$

whereby the instantaneous production $\dot{m}$ over a time interval $t_2-t_1$ can be expressed as:

$$\dot{m} = \frac{K\cdot\int_{t_1}^{t_2} n\cdot x\cdot dt}{t_2-t_1};$$

wherein, according to the invention, there is preferably selected for $t_2-t_1$ a constant time interval.

Based upon the graphic representation of FIG. 3 it will be observed the mass actually corresponds to the surface beneath the curve during the time interval $t_2-t_1$. Therefore, m represents the average or mean value during this time interval.

The regulation of the rotational speed of the feed rolls is undertaken as follows:

Firstly, there is determined the cross-section of the opening and such is integrated over the fixed time interval $t_2-t_1$ at a rotational speed $n_1$ which is constant throughout the measurement, resulting in the instantaneous production $\dot{m}$.

This value is now compared with the reference or set value production $\dot{m}_{ref}$ and the regulation of the rotational speed is undertaken such that there is produced a new rotational speed $n_2$ which remains constant for the next time interval.

This method is repeated time interval for time interval, and the regulation rapidly adjusts to the desired or reference average production value $\dot{m}_{ref}$. The computations can be undertaken by a microprocessor having knowledge of the constant parameters and to which there are delivered the continuous measurement results of the path measuring device or transducer 82, 84 and the rotational speed of the feed rolls 18 and 20. The drive of the different rolls will be more readily apparent from FIG. 4, there being depicted a somewhat modified roll arrangement in contrast to the roll arrangement shown in FIG. 2.

Figure 4:
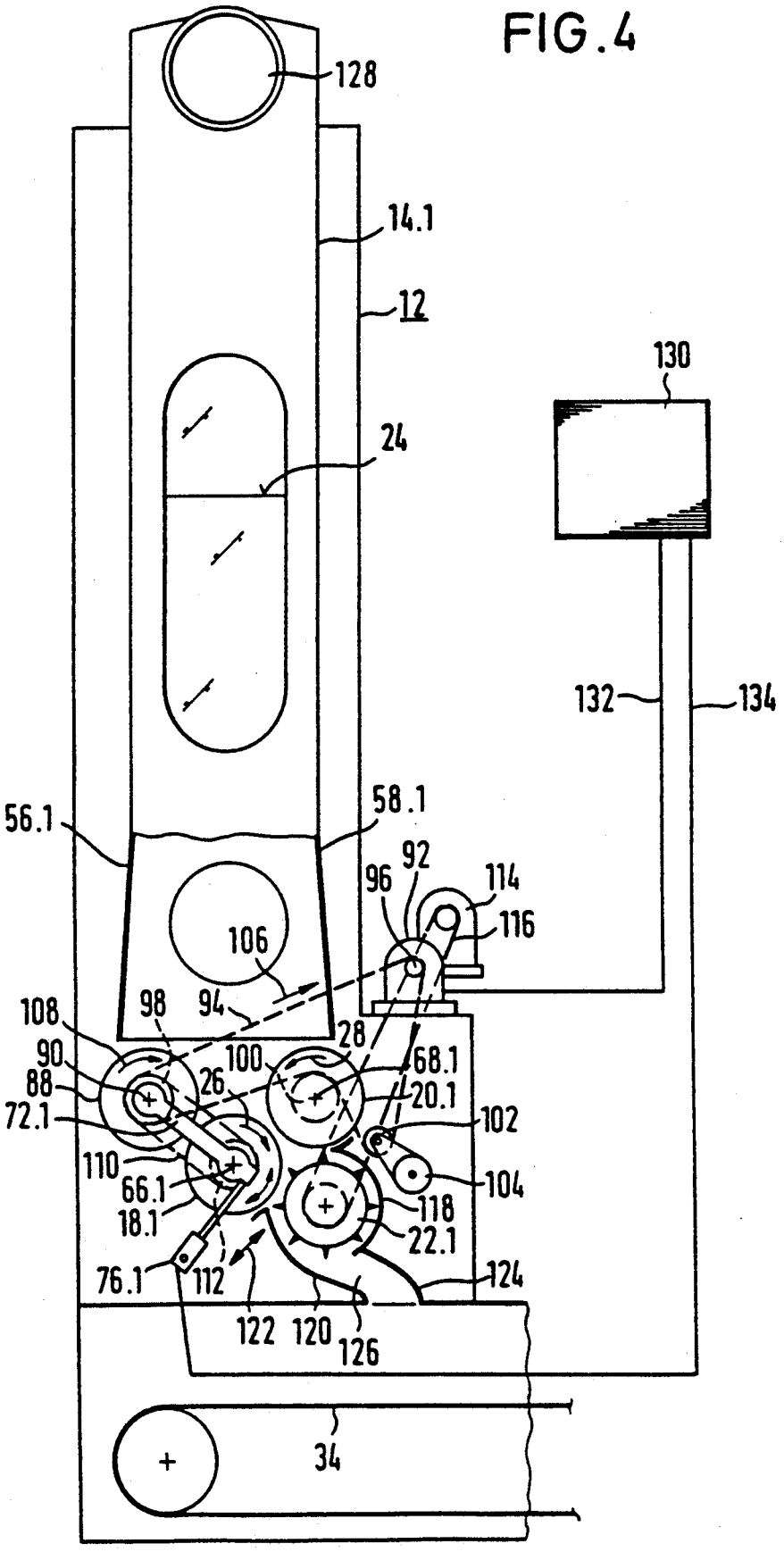
FIG. 4 is a side view of a first detailed embodiment of a dosing or metering apparatus according to the present invention.

FIG. 4 depicts a dosing or metering apparatus 12 which approximately corresponds to the dosing or metering apparatus 12 appearing at the left-hand side of FIG. 1. However, in this case there is provided a further roll 88 which delivers the fiber flocks in the filling chute 14.1 to the feed rolls 18.1 and 20.1.

In this exemplary embodiment, the feed roll 18.1 is constructed to be displaceable, however, in contrast thereto, the other feed roll 20.1 is spatially fixed in position. The rotational shaft 66.1 of the displaceable feed roll 18.1 is here also carried by two arms or guides 72.1, but in this embodiment are not supported by the rotational shaft of the opening or opener roll 22, rather by the rotational shaft or axle 90 of the further roll 88. The pre-biasing or pre-loading device 76.1 is arranged at the left side of the filling chute 14.1 and, just like for the arrangement of FIG. 2, engages at the arm or guide 72.1. To simplify the illustration, there have been conveniently omitted the showing of the spring and the path measuring device or transducer, but it is to be expressly understood that such structure is present in the same manner as in the arrangement of FIG. 2. Also, it is to be clearly understood, a further prebiasing or pre-loading device 76.1 is arranged at the region of the opposite side or end face of the feed roll 18.1.

The feed rolls 18.1 and 20.1 and the further roll 88 are driven by a common drive motor 92. The drive unit or power train comprises an endless chain 94 or equivalent structure which is driven by a sprocket wheel or sprocket 96 mounted at the output shaft of the drive motor 92. The endless chain 94 is trained about a sprocket wheel or sprocket 98 provided at on end face of the further roll 88 and about a further sprocket wheel or sprocket 100 arranged at the one end face of the feed roll 20.1 and also about a sprocket wheel or sprocket 102 serving to tension the endless chain 94 and thus equipped with a chain tensioning device 104. The direction of revolving motion of the endless chain 94 is indicated by the arrow 106, thus producing the desired direction of rotation 28 of the feed roll 20.1 and the desired direction of rotation 108 of the further roll 88. The feed roll 18.1 is driven by a further revolving endless chain 110 or equivalent structure which, in turn, is driven by a sprocket wheel or sprocket 98 constructed as a double or twin sprocket wheel or sprocket. The sprocket wheels or sprockets 100 and 98 and the sprocket wheel or sprocket 112 arranged at the region of one end face of the feed roll 18.1 have the same diameter, resulting in the same rotational speed of these rolls.

A separate drive motor 114 and a revolving endless chain 116 or equivalent structure drive the opening roll 22.1.

Reverting further to FIG. 4, there also will be seen the manner in which the opening roll 22.1 revolves within sheet metal guides 118 and 120. The sheet metal guide 120 is appropriately mounted to be adjustable in the direction of the double-headed arrow 122. The sheet metal guide 120 forms in conjunction with a further sheet metal guide 124 a guide channel or duct 126 for the flock layer or web. The particular configuration of the guide channel or duct 126 slows down the movement of the fiber flocks following there departure from the region of the opening roll 22.1 and gently deposits them upon the upper run 34 of the conveyor belt or band 10 without there being formed a pronounced air current or flow which otherwise could disturb the formation of the sandwich or layered structure of the fiber flocks upon this conveyor belt or band 34.

Reference numeral 128 represents the infeed duct or channel through which the fiber flocks are pneumatically conveyed or transported into the filling chute 14.1.

Finally, reference numeral 130 signifies the computer which controls the rotational speed of the feed rolls 18.1 and 20.1 via the line 132 and by means of the input line 134 receives the signal of the path measuring device or transducer installed at the pre-biasing device 76.1, comparable to what has been previously explained with reference to the embodiment of FIG. 2.

Figure 5:
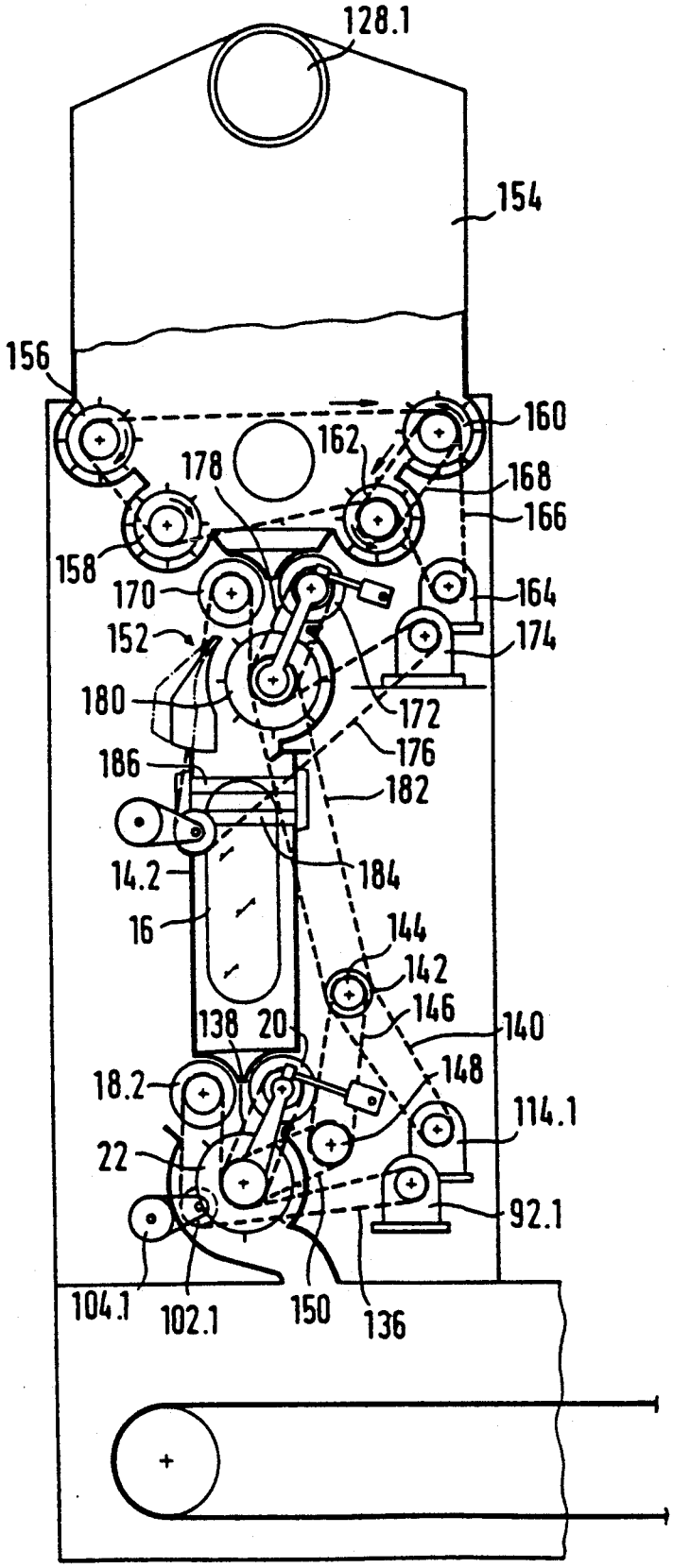
FIG. 5 is a side view of a further embodiment of a dosing or metering apparatus according to the present invention.

A further embodiment is depicted in FIG. 5, with the arrangement of the feed rolls 18.2 and 20 and the opening roll 22 corresponding to the arrangement of the analogous rolls of the embodiment of FIG. 2, wherefore it is unnecessary to further consider these elements or parts. However, mention is made of the fact that the drive motor 92.1 drives the feed roll 18.2 by means of the revolving endless chain 136 or equivalent structure. This revolving endless chain 136 is tensioned by the chain tensioning device or tensioner 104.1 and the tensioning sprocket wheel or sprocket 102.1. Three sprocket wheels or sprockets are seated upon the rotational shaft of the opening roll 22, one of which sprocket wheels is fixedly connected for rotation with this opening roll 22. Both of the other sprocket wheels are freely rotatable about the rotational shaft of the opening roll 22, but are appropriately interconnected or coupled with one another. As far as these two coupled sprocket wheels are concerned, one of them is driven by the revolving endless chain 136, and the other coupled sprocket wheel drives the feed roll 20 by means of a further revolving endless chain 138 or equivalent structure.

A second drive motor 114.1 drives an intermediate sprocket wheel or sprocket 142 by means of a revolving endless chain 140 or equivalent structure. This intermediate sprocket wheel 142 drives the opening roll 22 by means of the sprocket wheel which is rigidly or fixedly connected for rotation therewith through a power train comprising a further sprocket wheel or sprocket 144 coupled with the intermediate sprocket wheel 142, a revolving endless chain 146 or the like, a further double or twin sprocket wheel 148 as well as a further revolving endless chain 150 driving the sprocket wheel rigidly connected with the opening roll 22.

Above the filling chute 14.2 there is located a further dosing or metering device 152 having the task of maintaining the filling height or level of the fiber flocks within the filling chute 14.2 within predetermined boundaries or limits. For this purpose there are delivered to the further dosing or metering device 152 fiber flocks from a buffer chamber 154, and specifically by means of four delivery or feed rolls or rollers 156, 158, 160 and 162. These four delivery or feed rolls 156, 158, 160 and 162 are driven by their own drive motor 164, and specifically by means of a revolving endless chain 166. The respective directions of rotation of these four delivery or feed rolls 156, 158, 160 and 162 will be seen to be indicated by the associated arrows. In order to realize such rotational directions, it is necessary to drive the delivery or feed roll 160 by means of the delivery or feed roll 162 with the aid of a separate endless chain 168 or equivalent structure. It will therefore be seen that the revolving endless chain 166 is simply guided at the delivery or feed roll 160 by means of a freely rotatably mounted sprocket wheel.

As already explained, the dosing or metering device 152 is almost identical in its construction to the dosing or metering device located at the lower end of the filling chute 14.2. The drive of both of the feed rolls 170 and 172 is accomplished by means of the drive motor 174, and specifically, with the aid of a revolving endless chain 176 or equivalent structure which is essentially guided like the endless chain 136 at the lower end of the filling chute 14.2, wherefore it is unnecessary to further consider its exact arrangement. Also in this case the second feed roll 172 is driven by a separate revolving endless chain 78 or the like.

The opening roll 180 is driven by a sprocket wheel 142 by means of a further revolving endless chain 182, and it should be noted the sprocket wheel 142 is constructed as a double or twin sprocket wheel.

Light barriers 184 and 186 or equivalent structure, which control the upper and lower filling levels of the filling chute 14.2, serve to respectively activate and deactivate the dosing or metering device 152. Since the filling chute 14.2 is relatively wide, as measured in a direction perpendicular to the plane of the drawing of FIG. 6, two light barriers, like the light barriers 184 and 186 are arranged at each of both sides of the filling chute 14.2, so that there can be taken into account inclined positions of the upper boundary or level of the flock fill or supply within the filling chute 14.2. The switching-in or activation of the dosing or metering device 152 can be then perfected when both of the lower situated light barriers 184 are free or not interrupted, whereas the switching-off or deactivation of such dosing or metering device 152 can be accomplished when both of the upper situated light barriers 186 have their light beams interrupted by fiber flocks.

Different mass flows can be correlated to the dosing or metering device 152 depending upon the number of light barriers which have the light beams thereof interrupted by the fiber flocks. The lower light barriers 184 can safeguard against running empty of the filling chute 14.2, whereas the upper light barriers 186 can safeguard against excessive filling of fiber flocks into the filling chute 14.2.

Figure 6:
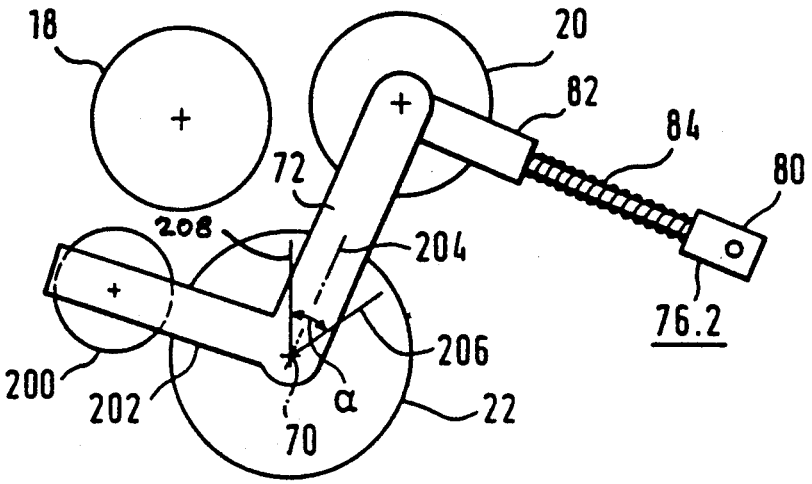
FIGS. 6, 7 and 8 are schematic illustrations of respective embodiments of pre-biasing or pre-loading devices which can be used in the dosing or metering apparatuses according to the present invention.

FIG. 6 schematically illustrates a pre-biasing or pre-loading device 76.2 for the one feed roll 20, this pre-biasing or pre-loading device 76.2 being quite similar to the pre-biasing or pre-loading device 76 of the embodiment of FIG. 2. In the embodiment of FIG. 6, there is, however, ensured that through astute geometry of the arrangement and by using the feed roll 20 as a compensation or equilibrium weight and through the provision of an additional compensation weight 200 there is guaranteed that throughout all positions of the feed roll 20 within the contemplated pivot range $\alpha$ there is exerted an at least essentially constant bias force upon the mass of fiber flocks 60 situated between the feed rolls 18 and 20.

It should be evident that with maximum opening angle $\alpha$, meaning a position of the arm 72 where its lengthwise axis 204 is located in the position 206, the spring 74 is compressed to a greater extent than in the illustrated position, and thus, the bias force exerted by the spring 74 assumes a maximum value. On the other hand, with maximum opening angle $\alpha$, the feed roll 20 exerts a greater compression or pressure force upon the spring 84, since the feed roll 20 then has a larger lever arm for the vertically downwardly directed weight force. The additional compensation weight 200, which exerts by means of the arm 202 a rotational moment or torque in the counterclockwise direction upon the arm 72, again produces an additional force in the direction of the force of the spring 84 upon the fiber flocks located between both of the feed rolls or rollers 18 and 20. In the angular position 206 this additional or supplementary force assumes a relatively small value. Therefore, the bias or loading force which is exerted upon the fiber flocks located between both of the feed rolls 18 and 20 assumes a value, in the position 206, which approximately corresponds to the difference between the maximum spring force and the maximum value of the weight force of the feed roll 20 which is directed against this spring force.

Conversely, if the arm 72 assumes the smallest angular position 208, that is, $\alpha=0°$, then the force of the spring 84 merely assumes its minimum value, and there is not exerted any pronounced counter force upon the spring 84 due to the weight of the feed roll 20. On the other hand, the additional or supplementary weight 200, due to the maximum length of the lever arm for vertically downwardly directed forces, exerts a maximum rotational moment or torque upon the arm 72 which augments the force exerted by the spring 84. Thus, the force exerted upon the fiber flocks located between the feed rolls 18 and 20 is composed of essentially the difference between the now reduced force of the spring 84 and the likewise reduced weight force of the feed roll 20 in addition to the simultaneously increased weight force of the additional or supplementary weight 200. Due to clever selection of the geometry as well a the individual weights and the spring force and spring constant, respectively, there can be ensured that the forces acting upon the fiber flocks located between the feed rolls 18 and 20 remain at least essentially constant throughout the entire angle range $\alpha$.

The equation for the system can be readily derived when the rotational moment or torque, exerted upon the arm 72 about the pivot or fulcrum axis defined by the rotational shaft 70, is computed as a function of the angle $\alpha$ and is set equal to zero for each angle $\alpha$. The optimum values for the individual weights and the spring force and spring constant then can be derived from these equations. It is also conceivable that even without the use of the additional or supplementary weight 200 there can be realized at least a good approximation of a constant bias or clamping force.

Of course, the arm or guide 72 need not be journaled for rotation about the rotational shaft 70 of the opening or opener roll 22. Instead, the pivot or hinge axis for the arm 72 can be selected such that the bias or clamping force exerted upon the fiber flocks remains constant, as desired.

Figure 7:
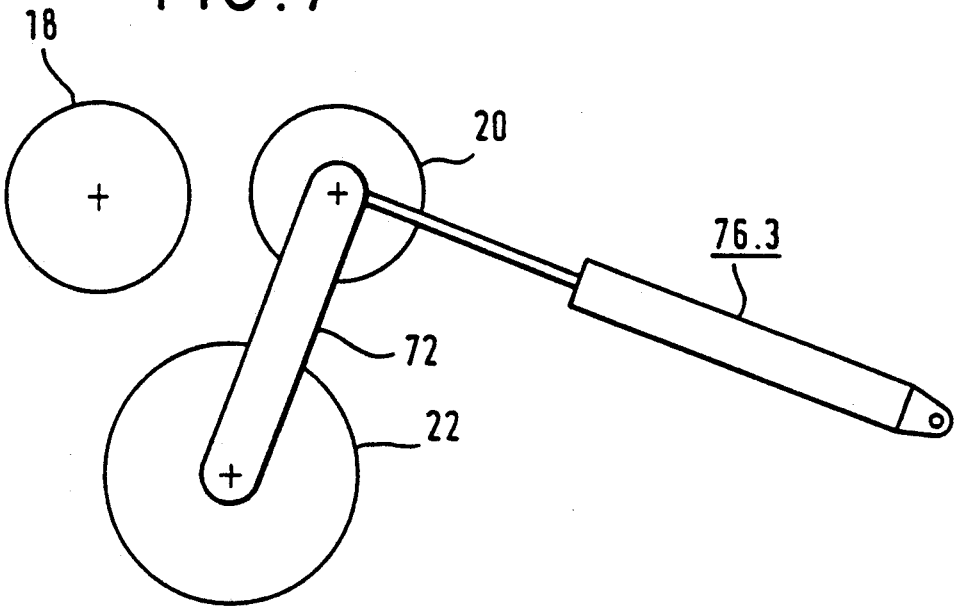

FIG. 7 depicts an alternative embodiment of the pre-biasing or pre-loading device 76.3, here structured as a gas pressure spring. Such a gas pressure spring possesses the characteristic of being able to exert a constant bias or clamping force over a relatively long stroke.

It should be understood that the arrangements depicted in FIGS. 6 and 7 at the one side or end face of the feed rolls 18 and 20 are duplicated in corresponding fashion at the opposite side or end face of such feed rolls 18 and 20.

Figure 8:
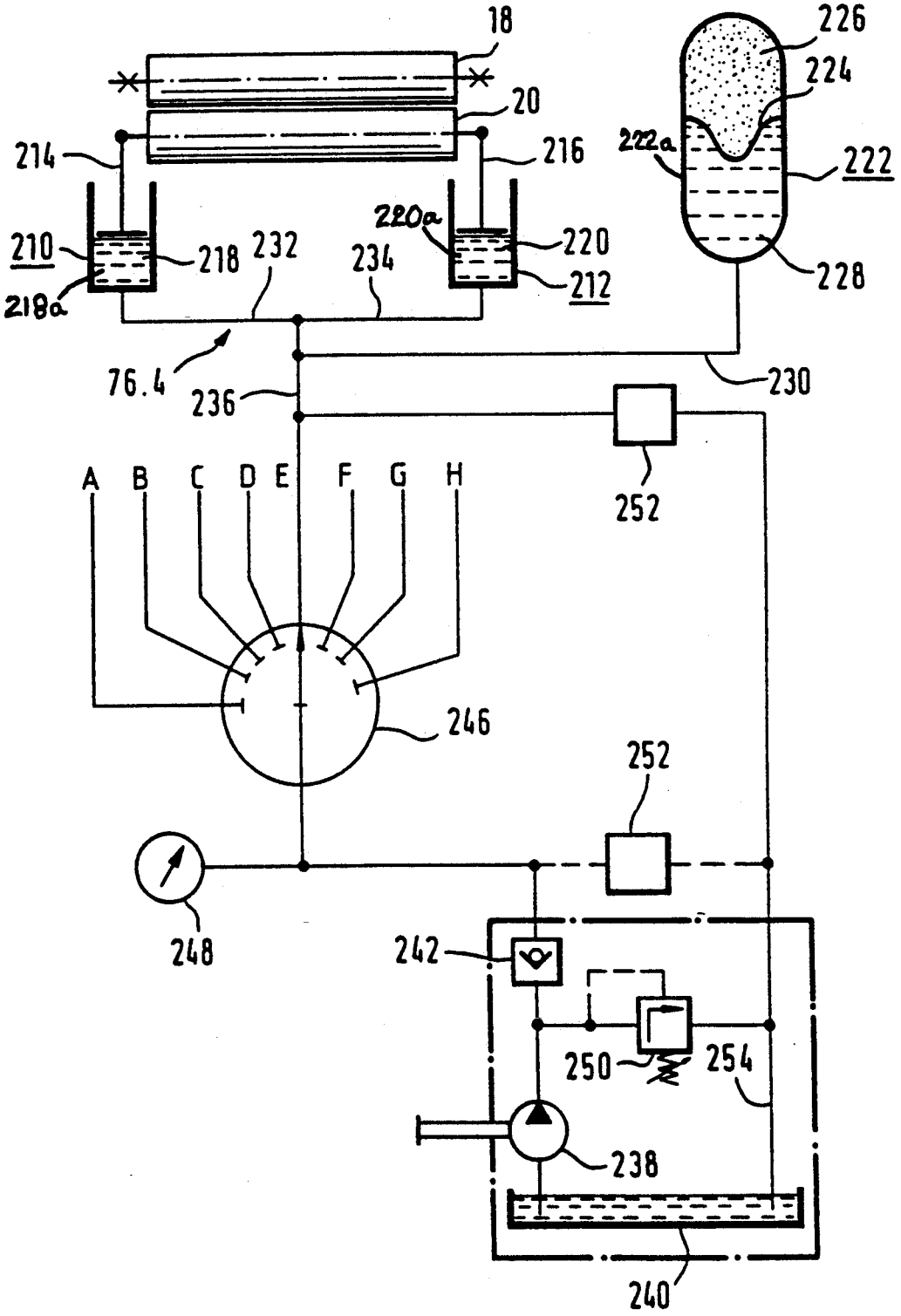

FIG. 8 depicts an hydraulic solution assigned the task of producing a constant bias or clamping force at the fiber flocks located between the feed rolls 18 and 20 which here also have been schematically illustrated. Instead of using the prior considered spring pre-biasing devices, here the pre-biasing or pre-loading device 76.4 is constituted by two piston-and-cylinder units 210 and 212 engaging at opposed ends of the shaft or axle of the feed roll 20. As an example of this arrangement, the piston rods 214 and 216 of both piston-and-cylinder units 210 and 212 can be articulated at the rotational shaft of the feed roll 20 and the cylinders 218 and 220 of both piston-and-cylinder units 210 and 212, respectively, can be articulated at the frame or the like of the associated filling or flock chute, like the filling chute 14 of the arrangement of FIG. 1. During operation, a pressure prevails in the cylinders 218 and 220 which is dictated by an accumulator 222.

This accumulator 222 comprises a cylinder **222*a* which is subdivided by a flexible membrane or diaphragm 224 or equivalent structure into two chambers or spaces 226 and 228. The chamber 226 is filled with a suitable gas, for instance, air, whereas the other chamber 228 contains an hydraulic liquid, this other chamber 228 flow communicating by means of the lines or conduits 230, 232 and 234 with the pressure chambers 218*a* and 220*a* of both of the cylinders 218 and 220, respectively. Prior to placing the dosing or metering apparatus into operation, an initial pressure is built-up in the hydraulic system, and specifically, by means of a line or conduit 236, as will be more fully considered shortly. A return flow by means of the line or conduit 236 is, however, not possible, as likewise will be considered hereinafter. By virtue of the set pressure the piston-and-cylinder units 210 and 212 exert a predetermined force upon the feed roll 20. If the position of the feed roll 20 changes by virtue of the flow of the fiber flocks, then, for example, liquid is displaced from the cylinders 218 and 220 into the chamber or space 228 of the accumulator 222, resulting in an increase in the volume of this chamber or space 228 and compression of the gas volume in the neighboring chamber or space 226. As long as the gas volume is relatively large in comparison to the displace volume of liquid, the pressure set in the system remains at least essentially constant, so that there is exerted a constant bias or clamping force upon the feed roll 20, and this bias or clamping force likewise is at least essentially independent of the actual position of the feed roll 20**.

In order to place the system into operation, in this embodiment there is provided a manually-operated or hand pump 238. This manually-operated pump 238 sucks hydraulic liquid out of a container or reservoir 240 and forces such sucked-up hydraulic liquid through a check valve 242 or the like and a distributor valve 246 into the pressure chambers or spaces **218*a*, 220*a* and 228. The pressure which has been established in these pressure chambers or spaces 218, 220 and 228 can be checked at a manometer 248 or equivalent structure. A pressure relief valve 250 ensures that the pressure generated by the pump 238 does not exceed a maximum value, for example, in the event of malfunction of the check valve 242. A further pressure relief valve 252 prevents build-up of excessive pressure in the hydraulic pressure system. If in the event of an excess pressure the pressure relief valve 250 or the further pressure relief valve 252 causes pressure relief in the system, then the relieved or tapped-off liquid flows back into the container or reservoir 240 through the line or conduit 254**.

In the arrangement under discussion, the distributor valve 246 is constructed, for example, such that there can be built-up the pressures at eight different filling or flock chutes, here generally indicated by reference characters A to H having associated dosing or metering apparatus as heretofore considered. For each filling chute A to H there are provided two piston-and-cylinder units or arrangements 210 and 212 as well as an accumulator 222 and the associated lines or conduits. The individual pre-biasing or pre-loading devices can be successively selected by means of the distributor valve 246. In the example under discussion, following setting of the pressure at the filling chute E, the distributor valve 246 is rotated into a closed position where there is interrupted the connection between the pump 238 and the individual pressure systems. It should be apparent that for this exemplary embodiment, a separate pressure relief valve 252 must be provided for each pressure system.

It is also possible to operate the system with a small pump 238 which constantly runs. In this case, there can be dispensed with the use of the accumulators 222. Instead, the pressure relief valve 252 is constructed such that it maintains a constant pressure. There can be provided a separate system for each filling chute, or all of the filling chutes can be simultaneously connected with a pump, in which case, there is needed only a single pressure relief valve 252, which then functions as a pressure regulating valve, for all of the filling chutes. In the last-mentioned situation all of the filling chutes A to H are connected by multi-way distributor with the pump 238.

Figure 9:
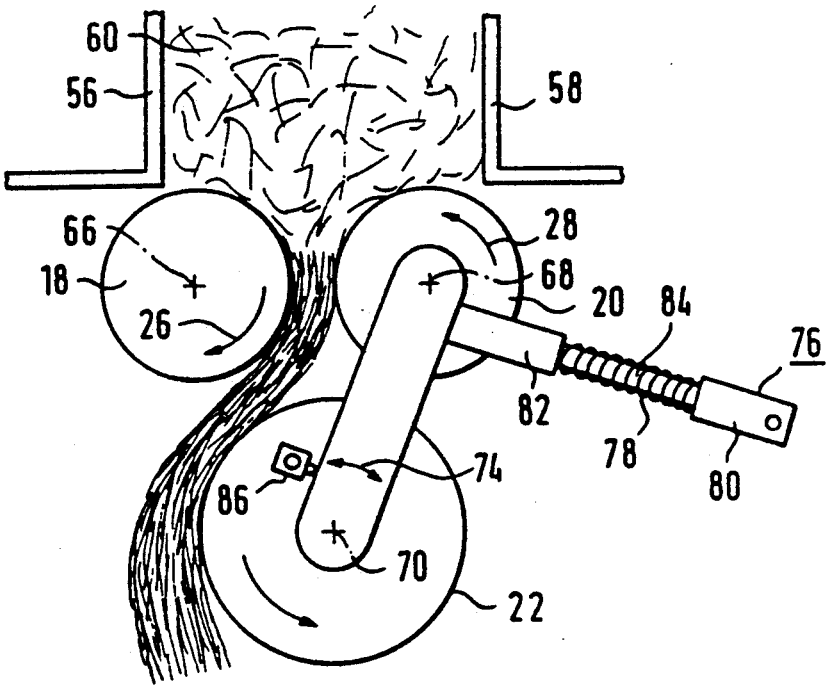
FIG. 9 is a side view of a modified construction of a dosing or metering apparatus from that shown in FIG. 2.

Turning attention now to FIG. 9, there is depicted an embodiment which is quite similar to the embodiment considered with reference to FIG. 2, wherein, however, the feed roll 18 is no longer intentionally driven, rather is merely arranged to be freely rotatable. This embodiment is predicated upon the recognition that the flow of fiber flocks which is produced by the feed roll 20 exerts considerable frictional forces upon the other feed roll 18, particularly in those situations where the outer surface of the feed roll 18 is not smooth, rather possesses a surface structure leading to an increased coefficient of friction. These frictional forces have been found to be completely adequate to drive a feed roll having a structured outer surface, like here assumed for the feed roll 18, at a surface speed or velocity which corresponds to the velocity of the flow of the fiber flocks, that is, to the surface speed of the feed roll 20.

Apart from this structural change, the construction of the embodiment of FIG. 9 essentially corresponds to the heretofore discussed embodiment of FIG. 2, wherefore there have been conveniently generally employed the same reference characters to denote the same elements or parts, so that there is believed to be unnecessary a further description of such like or corresponding elements or parts. It is sufficient to here mention that the rotational shaft 66 of the feed roll 18 is fixedly arranged, whereas the other feed roll 20 is driven for movement in the travel or direction of rotation 28. However, it would be equally possible to conversely only drive the feed roll 18 and to design the other feed roll 20 to be freely rotatable.

Figure 10:
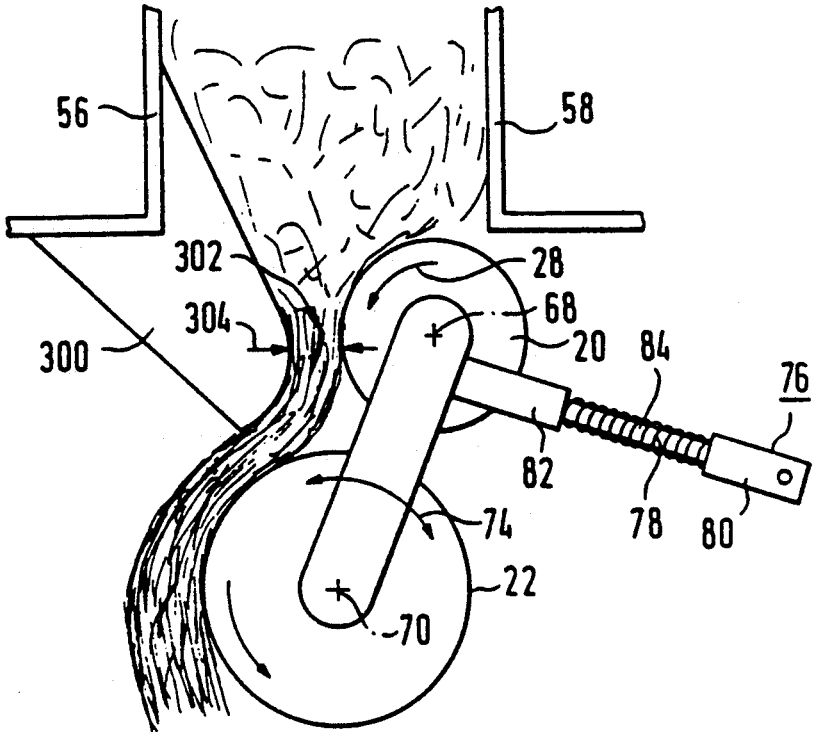
FIG. 10 is a side view, corresponding to the showing of FIG. 9, of a further embodiment of dosing or metering apparatus in which one of the feed rolls has been replaced by a slide.

In the embodiment of FIG. 10 the arrangement of the opening or opener roll 22 and the driven rotatable feed roll 20 has been kept intact, wherefore there have been used the same reference characters to denote the same elements or parts. However, here the feed roll 18 has been replaced by a stationary slide 300 or the like which forms in conjunction with the adjacently situated or confronting feed roll 20 a conveying or feed gap 302 having a minimum width or spacing at location 304, In the modified embodiment of FIG. 11, the slide 300 has been replaced by a revolving belt or band 306 which is trained about two deflection or guide rolls 308 and 310. For this embodiment, the upper deflection roll 308 is driven for rotation about the lengthwise or rotational axis of the rotational shaft or axle 312 in the direction of the arrow 314 at a speed or velocity such that the surface speed or velocity of the revolving belt or band 306 in the direction of the arrow 316 is equal to the surface speed or velocity of the rotatable feed roll 20.

The arrangement of the rotatable feed roll 2 and the opening roll 22 corresponds to the arrangement of FIG. 2, which has been represented by the use of the same reference characters. As such, and with the view of brevity in the description, there is no need to repeat the prior discussion of such roll arrangement.

When using a driven revolving feed belt or band 306 it is not absolutely necessary to provide a deflection or guide roll 310 at the lowermost region of the loop formed by such belt or band 306. Instead, the belt or band 306 can be guided, for instance, over a substantially triangular guide body or body member 318.

Figure 11:
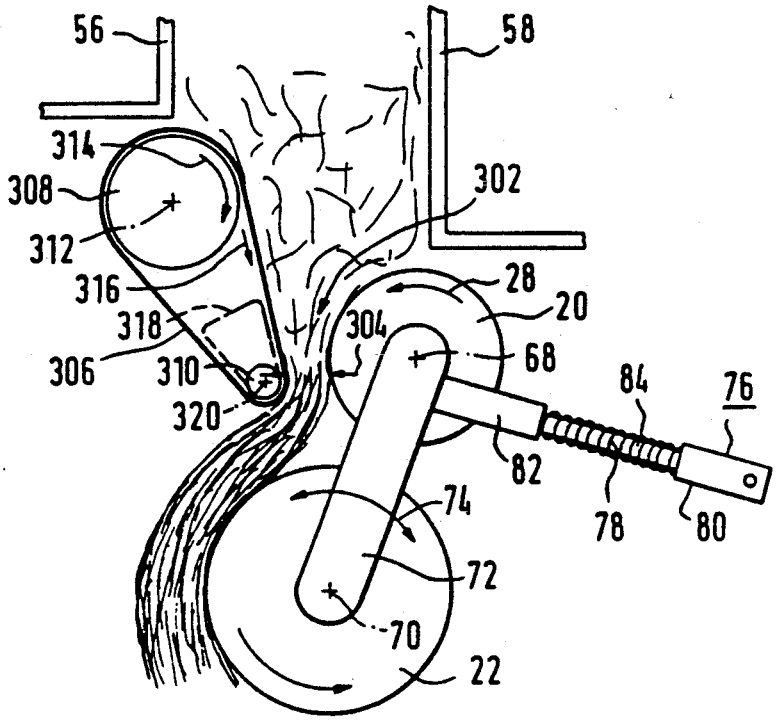
FIG. 11 is a side view, corresponding to the showing of FIG. 9, of a still further embodiment of dosing or metering apparatus in which one of the feed rolls has been replaced by a revolving band or belt.

With this embodiment depicted in FIG. 11, it is also, however, possible to dispense with positive driving of the belt or band 306, and, instead, it can be entrainably moved by the frictional forces exerted by the flow of the fiber flocks. In that case, it is desirable to provide a deflection roll or roller 310 which is freely rotatable about the axis 320, in addition to the then likewise freely rotatable deflection roll or roller 308, so that there is kept at a minimum the friction preventing the free movement of the revolving belt or band 306.

In this embodiment, the minimum width or spacing 304 of the conveying or feed gap 302 is likewise situated at the lower end of the revolving belt or band 306.

Figure 12:
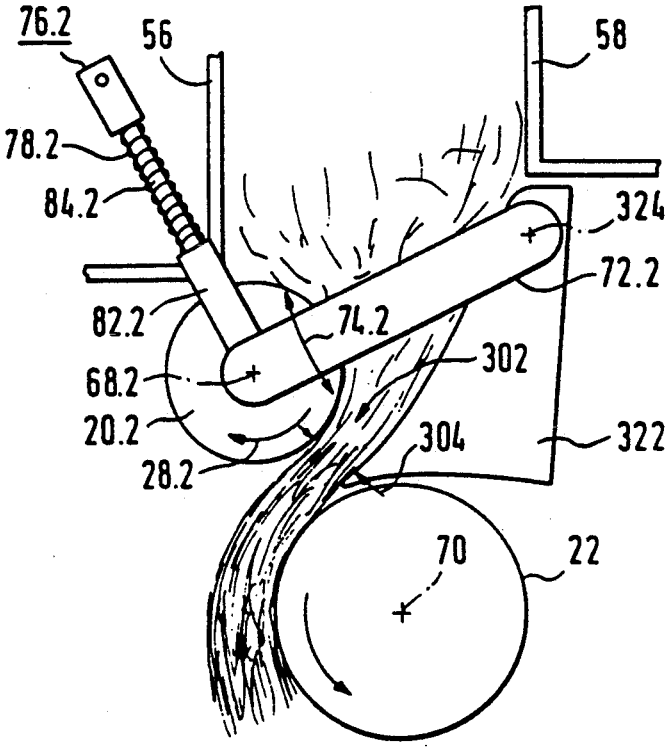
FIG. 12 is a side view, corresponding to the showing of FIG. 9, of yet a further embodiment of dosing or metering apparatus in which one of the feed rolls has been replaced by a feed trough or plate.

The modified embodiment of FIG. 12 depicts a driven feed roll 20.2 and a stationary feed trough 322. The feed roll 20.2 is rotatable in the direction of the arrow 28.2 about the lengthwise axis of the rotational shaft 68.2. This rotational shaft 68.2 is supported at both of its opposite ends by the pivotable guides or arms 72.2, and both of these pivotable guides or arms 72.2—of which only one is visible in the showing of FIG. 12—are articulated at the upper end of the stationary feed trough 322 at the pivot shaft 324. The conveying or feed gap 302, in this embodiment, has its minimum width or spacing at location 304. Such mounting of the feed roll 20.2 renders possible changing of the minimum width at location 304 by appropriately pivoting the guides or arms 72.2 in the direction of the indicated double-headed arrows 74.2.

Here, the pre-biasing device 76.2 is constructed in correspondence with the pre-biasing device 76 of the embodiment of FIG. 2, however engages from above at the lower end of the guide or arm 72.2, and thus, forces the feed roll 20.2 in the direction of the feed trough 322.

Figure 13:
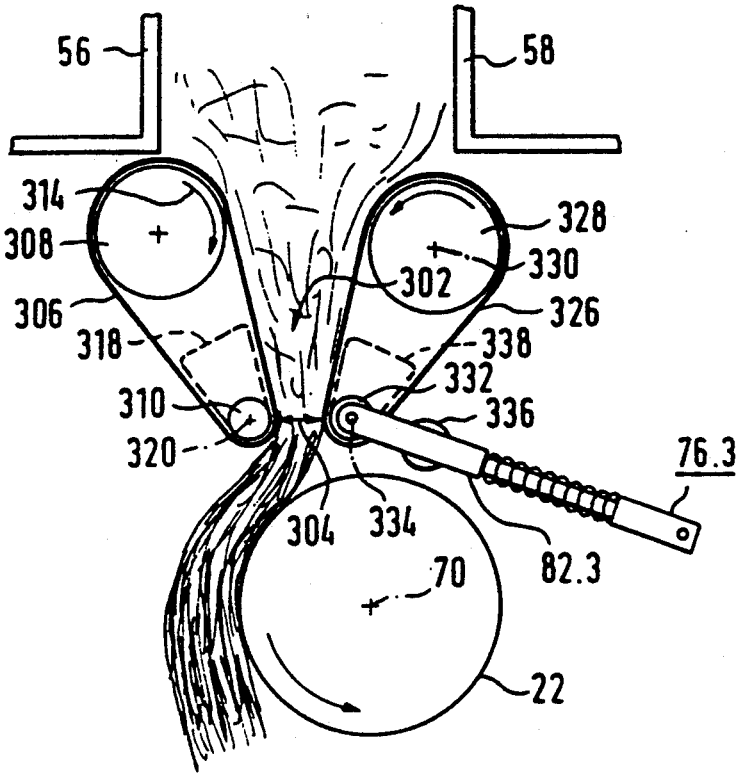
FIG. 13 is a side view of a further embodiment of dosing or metering apparatus corresponding to FIG. 2, however using two revolvingly driven belts or bands.

In the embodiment of FIG. 13 both of the feed rolls 18 and 20 have been replaced by revolving endless belts or bands 306 and 326. The arrangement of the revolving endless belt 306 about the two deflection rolls 308 and 310 fully corresponds to the arrangement of the corresponding revolving endless belt or band 306 of the arrangement of FIG. 11, explaining why this arrangement of FIG. 13 has the same elements or parts designated by the same reference numerals used in the embodiment of FIG. 11. As such, no further discussion is warranted.

The revolving endless belt or band 326 is constructed approximately the same, meaning that it travels about an upper deflection roll 328 which is appropriately driven and rotates about the lengthwise axis of the rotational shaft 330. This revolving endless belt 326 is also trained about a lower deflection roll 332 which is arranged to be freely rotatable about the lengthwise axis of the rotational shaft 334. At both ends of the rotational shaft 334 there engages a pre-biasing or pre-loading device 76.3 which essentially corresponds to the pre-biasing devices heretofore considered with reference to the previously discussed embodiments, however contains the additional feature that the elements or parts 82.3 at both ends of the rotational shaft 334 are interconnected by a sturdy or stabile rod or bar 336 in order to ensure that the gap width at the narrowest location 304 of the conveying or feed gap 302 remains essentially constant throughout the entire axial length of the deflection rolls 310 and 332. It is to be understood that such sturdy rod or bar 336 can also be used with the other heretofore considered embodiments. The rotational shaft 330 of the deflection 328 together with the rotational shaft 334 of the deflection roll 332 are mounted at a not particularly shown common support or carrier body for pivotal movement about the lengthwise axis of the rotational shaft 330.

In this embodiment, either both of the revolving endless belts 306 and 326 can be driven to move at the same surface speed or velocity, or optionally either only the revolving endless belt 306 is driven or either only the other revolving endless belt 326 is driven, and in each such case the other non-driven revolving endless belt then can freely revolve or circulate. In the case of freely revolving endless belts it is preferable to design the lower deflection location to incorporate a freely rotatable roll. When working with driven revolving endless belts there can be, however, provided deflection elements, like the deflection bodies or elements 318 and 338, wherein, for example, the deflection body 318 can be stationarily arranged and the other deflection body 338 movably arranged. In this connection, the mobility of the deflection body 338 is limited to a pivotal movement about the lengthwise axis of the rotational shaft 330. Also in the case of this exemplary embodiment, during operation the minimum width of the conveying gap alters at location 304 and the changes of such width or spacing between the belts 306 and 326 is taken into account during the regulation of the surface speed or velocity of the revolving driven endless belt or belts.

Figure 14:
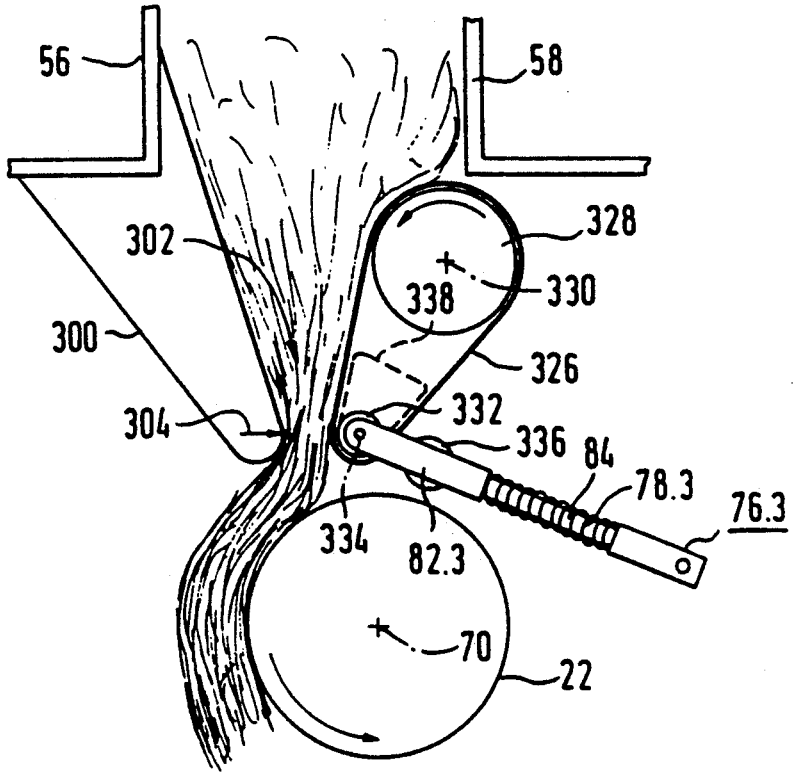
FIG. 14 is a side view, corresponding to the showing of FIG. 13, of a modified embodiment of dosing or metering apparatus in which one of the revolvingly driven belts or bands has been replaced by a slide.

FIG. 14 depicts an embodiment which essentially constitutes a further modification of the embodiment of FIG. 10, wherein, here, the rotatable feed roll 20 is replaced by a revolving endless belt or band 326 corresponding to the embodiment of FIG. 13. Since the arrangement of the revolving endless belt 326 has already been fully described with reference to the embodiment of FIG. 13, it is unnecessary to again describe such structure. Attention is only directed to the fact that, in this embodiment, the revolving endless belt 326 must define a driven revolving endless belt. Also with this embodiment, during operation the gap width alters at location 304, and changes of such gap width are taken into account during regulation of the surface speed or velocity of the driven revolving endless belt 326. This surface or revolving velocity is here, of course, predetermined, just like for all other embodiments employing revolving endless belts, by the rotational speed of the associated deflection roll, in this case the deflection roll 328.

Figure 15:
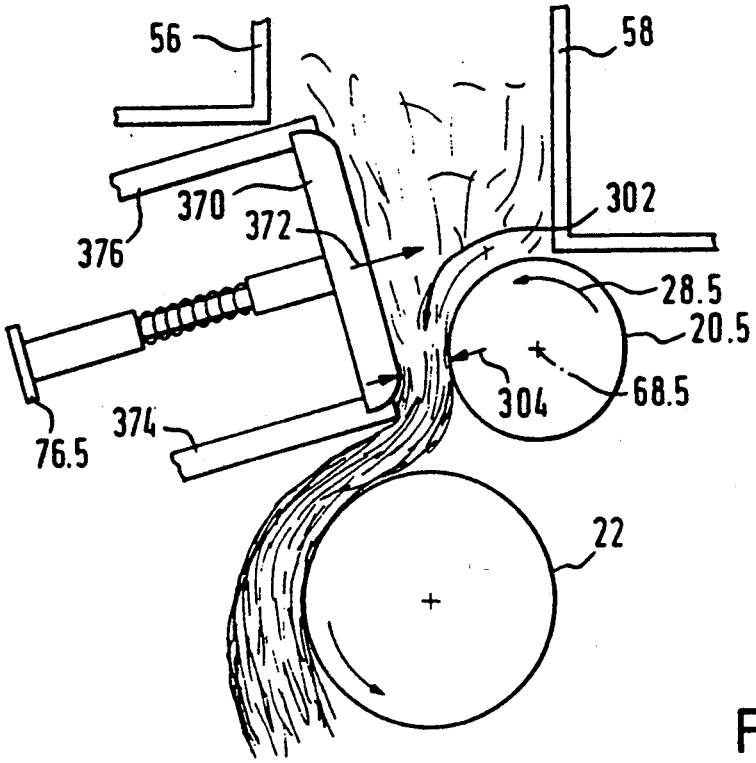
FIG. 15 is a side view, corresponding to the showing of FIG. 12, of another embodiment of dosing or metering apparatus.

Regarding the modified embodiment of FIG. 15, there is shown a construction where the feed roll 20.5 is rotatably driven in the direction of the arrow 28.5 about a stationary rotational axle or shaft 68.5. In this embodiment, the prior considered feed roll 18 is replaced by a spring-loaded plate or plate member 370, in other words, this plate 370 is biased or loaded in the direction of the arrow 372 towards the mass of fiber flocks by the pre-biasing or pre-loading device 76.5. Guides or guide members 374 and 376, arranged beneath and above as well as to both sides of the spring-loaded plate 370, ensure that this plate 370 only has mobility in the direction of the arrow 372. Also here the measuring device or transducer which delivers a signal representative of the change in the spacing of the minimum width of the conveying or feed gap 302 at location 304, is incorporated into the pre-biasing device 76.5.

Instead of using the spring-loaded or spring-biased plate 370 of the described construction, such plate could be inherently constructed as a blade spring or the like, in which case, then, there would be required a separate measuring sensor or feeler for detecting the changes in the spacing of the minimum width of the conveying or feed gap 302 at location 304 arising during operation.

Figure 16:
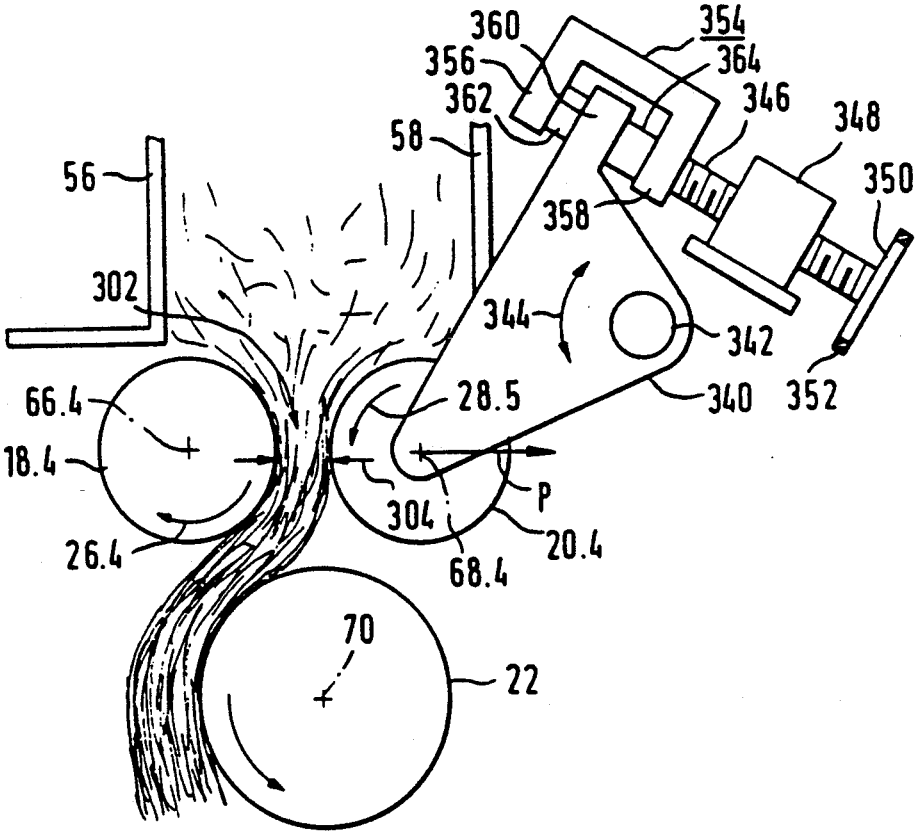
FIG. 16 is a side view of an embodiment of dosing or metering apparatus corresponding to the showing of FIGS. 2 and 9, respectively, wherein, however, both of the feed rolls possess a constant mutual spacing from one another.

Finally, FIG. 16 depicts a further modified arrangement of the embodiment of FIG. 2, wherein, however, both of the feed rolls 18.4 and 20.4 should have a fixed spacing from one another for a desired or reference instantaneous production $\dot{m}_{ref}$. These feed rolls 18.4 and 20.4 rotate about fixedly disposed rotational axles or shafts 66.4 and 68.4, and specifically in the directions of rotation indicated by the arrows 26.4 and 28.5. The opening roll 22 rotates about the lengthwise axis of the likewise fixedly arranged rotational axle or shaft 70.

The rotational axle or shaft 68.4 of the feed roll 20.4 is supported at both of its oppositely situated ends at plates 340 which in front view each have a substantially triangular configuration (only one such triangular plate or plate member 340 is visible in the showing of FIG. 16). Both of these substantially triangular plates 340 are interconnected by suitable connection rods or bars, like, for instance, the rods or bars 336 shown in FIGS. 13 and 14. The plates 340, in turn, are mounted for pivotal or swivel movement about the stationarily arranged rotational or pivot axle or shaft 342, as generally indicated by the double-headed arrow 344. During operation, there is, however, chosen a fixed position of the triangular plates 340 and thus also of the rotational shaft or axle 68.4 of the feed roll 20.4. Here, such is accomplished by the threaded spindle 346 which piercingly extends through a sturdy or massive part 348 provided with internal threading. This part or element 348 is fixed to the machine frame. A manually-operated or hand wheel 350, which also can be replaced by a motor drive, renders possible rotating the threaded spindle 346 so that there can be predetermined the position of the triangular plates 340. Since a corresponding threaded spindle arrangement is also provided for the other non-visible triangular plate, both of the spindle drives should be operatively coupled with one another, something which can be accomplished, for instance, by the depicted revolving belt or band 352 or the like.

A yoke or substantially U-shaped bracket 354 is located at the end of each threaded spindle 346, the legs or limbs 356 and 358 of which are arranged in straddling fashion at the respective side of a lug portion 360 of the associated triangular plate 340. Between each leg 356 and 358 and the lug portion 360 there are located force measuring cells 362 and 364 or equivalent structure which are connected by suitable lines with the computer, like the computer 130 depicted in FIG. 4. During operation, both of the feed rolls 18.4 and 20.4 convey the fiber flocks through the conveying gap 302 and through the location 304 of minimum width or spacing, and a force P acts upon the feed roll 20.4 which strives to pivot the triangular plates 340 about the pivot or rotational axle or shaft 342. An actual pivotal movement does not arise because it is prevented by the previously described threaded spindle-yoke arrangements. However, the force measuring cells 362 and 364 render possible the determination of the magnitude of this force P by the computer which also takes into account the geometric conditions.

Fluctuations of this force P correspond to the fluctuations or variations in the density of the flow of the fiber flocks at the location 304 and are processed by the computer for regulating the rotational speed of the feed roll 20.4 and, if required, also the rotational speed of the other feed roll 18.4, in the event this other feed roll itself is driven or driven in lieu of the feed roll 20.4, so that there can be maintained the desired mass or reference flow $\dot{m}_{ref}$.

If it is desired to alter the production of the filling chute, like the filling chute 14 shown in FIG. 1, then such can be solely accomplished by altering the rotational speed or velocity of the feed roll 20.4 and, if necessary, the feed roll 18.4. However, in order to achieve a wider adjustment range, the threaded spindle 346 can be used to alter or set the minimum width of the conveying gap 302 at location 304, so that changes in the rotational speed of the feed rolls can be maintained within prescribed or predetermined limits independent of the momentarily contemplated production $\dot{m}_{ref}$.

In conclusion, it should still be mentioned that the embodiment of FIG. 16, where there is maintained constant the minimum width or spacing of the conveying gap 302 at location 304, and there is measured the magnitude of the force P which strives to push apart the feed devices, here the feed rolls 18.4 and 20.4, can be analogously used in all further constructional embodiments instead of the described pre-biasing devices.

Although the pre-biasing devices 76, 76.3 and 76.4 have been shown in FIGS. 9 to 14 like the pre-biasing device of the embodiment of FIG. 2, it should be understood that in actual practice these pre-biasing devices should be preferably realized by gas pressure springs or hydraulic arrangements, in order to maintain the biasing force constant independent of the changes in the minimum width or spacing between the feed devices at 47 location 304. Also, with the newly devised and herein described exemplary embodiments the geometry ca be partially selected such that there arise compensation forces which also, when using a conventional pressure or compression spring, result in a force which, with adjustment of the one feed device, does not result in or only to a slight degree results in a change in the pre-biasing force.

It should be clearly understand that for all embodiments plates are provided at the opposed end faces or sides of the feed devices and the opening roll, respectively, which bound the fiber flock mass and the flow of the fiber flocks at the sides of the conveying or feed gap.

While there are shown and described present preferred embodiments of the invention, it is distinctly to be understood the invention is not limited thereto, but may be otherwise variously embodied and practiced within the scope of the following claims.

What is claimed is:

1. A dosing method for metering predeterminate quantities of fiber flocks per unit time, comprising the steps of:

delivering fiber flocks from a filling chute by means of two feed devices arranged at the lower end of the filling chute, the two feed devices forming therebetween a conveying gap through which there are transported the fiber flocks;

selectively choosing as the feed devices an arrangement comprising a member selected from the group consisting of:

(a) a rotatable driven feed roll and an oppositely situated slide;

(b) a rotatable driven feed roll and an oppositely situated revolving belt which is selectively either driven or freely revolves;

(c) two oppositely situated revolving belts, at least one of the revolving belts is driven and the other selectively either revolves or is likewise driven;

(d) a driven revolving belt and an oppositely situated slide;

(e) a rotatable driven feed roll and an oppositely situated freely rotatable further feed roll; and (f) a rotatable driven feed roll and an oppositely situated feed trough;

wherein, for all of the possibly selected arrangements (a) to (f) of the feed devices the conveying gap converges to a minimum width x;

pre-biasing at least one of the feed devices in the direction of the other feed device and enabling movement of at least the one of the feed devices away from the other feed device by the force of the fiber flocks such that the spacing between both of the feed devices is changed in the sense of altering the minimum width x of the conveying gap;

determining the minimum width x of the conveying gap or a value proportional thereto; and regulating the surface velocity u of each driven feed device in a manner such that at least an average value of the product x·u of the minimum width x and the surface velocity u remains essentially constant.

2. The dosing method as defined in claim 1, further including the step of:

feeding the fiber flocks to an opening roll arranged beneath the feed devices.

3. The dosing method as defined in claim 1, wherein:

the step of regulating the surface velocity of each driven feed device is undertaken by integrating the product u·x throughout a predetermined time interval $t_2-t_1$;

deriving from the integration the instantaneous production $\dot{m}$ according to the following Equation:

$$m = \frac{K \cdot \int_{t_1}^{t_2} \cdot u \cdot x \cdot dt}{t_2 - t_1};$$

wherein, K represents a constant;

comparing the actual value m of the instantaneous production with a reference value $m_{ref}$ of the instantaneous production; and computing from this comparison a new surface velocity for the next time interval in the sense of having a next value of the instantaneous production m approach a reference value $m_{ref}$ of such instantaneous production m.

4. The dosing method as defined in claim 3, further including the step of:

regulating the surface velocity u within each time interval to a momentary constant value.

5. A dosing apparatus for metering predeterminate quantities of fiber flocks per unit time, comprising:

a filling chute for fiber flocks and having a lower end;

two feed devices arranged at the lower end of the filling chute for delivering the fiber flocks from the filling chute;

the two feed devices forming therebetween a conveying gap through which there are transported the fiber flocks, wherein the feed devices comprise a member selected from the group consisting of:

(a) a rotatable feed roll and an oppositely situated slide;

(b) a rotatable feed roll and an oppositely situated revolving belt which is selectively either driven or freely revolves;

(c) two oppositely situated revolving belts, at least one of the revolving belts is driven and the other selectively either revolves or is likewise driven;

(d) a driven revolving belt and an oppositely situated slide;

(e) a rotatable feed roll and an oppositely situated freely rotatable further feed roll; and (f) a rotatable feed roll and an oppositely situated feed trough;

wherein, for all of the possible selected arrangements (a) to (f) of the feed devices the conveying gap converges to a minimum width x;

a per-biasing device for biasing at least one of the feed devices in the direction of the other feed device;

means mounting at least the one of the feed devices to be movable away from the other feed device by the force of the fiber flocks such that the spacing between both of the feed devices is changed in the sense of altering the minimum width x of the conveying gap;

a path measuring device for determining the minimum width x of the conveying gap or a value proportional thereto defining the spacing between the feed devices which prevails during operation of the dosing apparatus; and means for regulating the surface velocity u of each movable feed device as a function of the determined spacing between the feed devices in a manner such that there is achieved a predetermined reference value $\dot{m}_{ref}$ of the instantaneous production $\dot{m}$.

6. The dosing apparatus defined in claim 5, further including:

an opening roll arranged beneath the feed devices for opening the fiber flocks received from the feed devices.

7. The dosing apparatus defined in claim 5, wherein:

the feed devices comprise said rotatable feed roll and said oppositely situated slide;

means for fixedly arranging said rotatable feed roll; and said slide comprising a spring plate which can be displaced away from the rotatable feed roll.

8. The dosing apparatus defined in claim 5, wherein:

the pre-biasing device comprises at least one spring having a spring force which remains essentially constant within a predetermined displacement path of the pre-biasing device.

9. The dosing apparatus defined in claim 5, wherein:

the pre-biasing device comprises at least one clamping element having a force which remains essentially constant within a predetermined displacement path of the pre-biasing device.

10. The dosing apparatus defined in claim 5, wherein:

the pre-biasing device comprises at least one gas pressure spring.

11. The dosing apparatus defined in claim 5, wherein:

the pre-biasing device comprises at least one spring;

at least one compensation weight for at least partially compensating the reduction of a clamping force with decreasing spacing between the feed devices; and at least a part of the compensation weight being formed by one of the feed devices.

12. The dosing apparatus defined in claim 11, wherein:

said at least one compensation weight is entirely formed by one of the feed devices.

13. The dosing apparatus defined in claim 5, wherein:

the pre-biasing device comprises an hydraulic pre-biasing device;

said hydraulic pre-biasing device comprising:

displacement means activated by movement of one of the feed devices; and an accumulator connected with the displacement means.

14. The dosing apparatus defined in claim 5, wherein:

the pre-biasing device comprises an hydraulic pre-biasing device;

said hydraulic pre-biasing device comprising:

a compensated arrangement comprising a pressure system generating an at least essentially constant pressure.

15. A dosing method for metering predeterminate quantities of fiber flocks per unit of time, comprising the steps of:

delivering fiber flocks from a filling chute by means of two feed devices arranged at the lower end of the filling chute, the two feed devices forming therebetween a conveying gap through which there are transported the fiber flocks;

selectively choosing as the feed devices an arrangement comprising a member selected from the group consisting of:

(a) two oppositely situated feed rolls, wherein at least one of the feed rolls is driven and the other selectively either revolves or is likewise driven;

(b) a rotatable driven feed roll and an oppositely situated slide;

(c) a rotatable driven feed roll and an oppositely situated driven or freely revolving belt;

(d) two oppositely situated revolving belts, wherein at least one of the revolving belts is driven and the other either revolves or is likewise driven;

(e) a driven revolving belt and an oppositely situated slide;

(f) a rotatable driven feed roll and an oppositely situated freely rotatable further feed roll; and (g) a rotatable driven feed roll and an oppositely situated feed trough;

maintaining at least essentially constant the relative position of both of the feed devices located mutually opposite one another during simultaneous measurement of the force P which urges apart both of the feed devices or a value proportional thereto;

regulating the surface velocity u of each driven feed device while taking into account the force which changes during operation, in order that at least the average value of the product u·p of this surface velocity u and the force P remains essentially constant.

16. The dosing method as defined in claim 15, further including the step of:

feeding the fiber flocks to an opening roll arranged beneath the feed devices.

17. A dosing apparatus for metering predeterminate quantities of fiber flocks per unit of time, comprising:

a filling chute for fiber flocks and having a lower end;

two feed devices located in the lower end of the filling chute for delivering the fiber flocks from the filling chute;

the two feed devices forming therebetween a conveying gap through which there are transported the fiber flocks, wherein the feed devices comprise a member selected from the group consisting of:

(a) two oppositely situated feed rolls, wherein at least one of the feed rolls is driven and the other selectively either revolves or is likewise driven;

(b) a rotatable driven feed roll and an oppositely situated slide;

(c) a rotatable driven feed roll and an oppositely situated driven or freely revolving belt;

(d) two oppositely situated revolving belts, wherein at least one of the revolving belts is driven and the other either revolves or is likewise driven;

(e) a driven revolving belt and an oppositely situated slide;

(f) a rotatable driven feed roll and an oppositely situated freely rotatable further feed roll; and (g) a rotatable driven feed roll and an oppositely situated feed trough;

wherein, for all of the indicated arrangements (a) to (g) of the feed devices the conveying gap converges to a minimum width;

the relative position of both of the feed devices located mutually opposite one another remaining essentially constant;

a force measuring device for measuring the force P which strives to urge apart both of the feed devices; and a regulator for regulating the surface velocity u of each driven feed device as a function of the measured force such that there is realized a predeterminate reference value $\dot{m}_{ref}$ of the instantaneous production $\dot{m}$.

18. The dosing apparatus defined in claim 17, further including:

an opening roll arranged beneath the feed devices for opening the fiber flocks received from the feed devices.

* * * * *